US008661754B2

(12) United States Patent
Hsu et al.

(10) Patent No.: US 8,661,754 B2
(45) **Date of Patent: *Mar. 4, 2014**

(54) SYSTEM AND METHOD OF USE FOR COMPOSITE FLOOR

(75) Inventors: Cheng-Tzu Thomas Hsu, Hazlet, NJ (US); Sun Punurai, Bangkok (TH); Pedro R. Munoz, Newburyport, MA (US)

(73) Assignee: New Jersey Institute of Technology, Newark, NJ (US)

( * ) Notice: Subject to any disclaimer, the term of this patent is extended or adjusted under 35 U.S.C. 154(b) by 338 days.

This patent is subject to a terminal disclaimer.

(21) Appl. No.: 12/857,670

(22) Filed: Aug. 17, 2010

(65) Prior Publication Data

US 2011/0113714 A1 May 19, 2011

Related U.S. Application Data

(63) Continuation-in-part of application No. 11/820,250, filed on Jun. 19, 2007, now Pat. No. 7,779,590.

(60) Provisional application No. 60/815,340, filed on Jun. 20, 2006.

(51) Int. Cl.

| | |
|---|---|
| ***E04B 5/17*** | (2006.01) |
| ***E04B 5/18*** | (2006.01) |
| ***E04B 5/40*** | (2006.01) |

(52) U.S. Cl.

USPC ..... 52/334; 52/328; 52/335; 52/414; 52/289; 52/703

(58) Field of Classification Search

USPC ..... 52/327, 328, 334, 335, 340, 341, 351, 52/414, 450, 289, 702

See application file for complete search history.

(56) References Cited

U.S. PATENT DOCUMENTS

| | | | | | |
|---|---|---|---|---|---|
| 625,427 | A | * | 5/1899 | Stewart | 403/190 |
| 866,715 | A | * | 9/1907 | Cobb | 52/335 |
| 1,097,934 | A | * | 5/1914 | Price | 403/190 |
| 1,574,328 | A | | 2/1926 | White | |
| 1,627,009 | A | * | 5/1927 | Berry | 264/33 |
| 1,768,626 | A | | 7/1930 | Pedersen | |
| 1,872,984 | A | * | 8/1932 | Land | 52/452 |
| 1,974,730 | A | | 9/1934 | Zollinger | |
| 2,340,176 | A | | 1/1944 | Cueni et al. | |
| 2,479,475 | A | | 8/1949 | Cueni | |
| 2,663,270 | A | * | 12/1953 | Friedly | 52/483.1 |
| 2,945,328 | A | | 7/1960 | Webb | |

(Continued)

FOREIGN PATENT DOCUMENTS

| | | |
|---|---|---|
| CA | 2030101 | 7/2000 |

OTHER PUBLICATIONS

Hambro literature four (4) pages, May 14, 2008.

PCT International Search Report dated Aug. 1, 2008.

(Continued)

*Primary Examiner* — Robert Canfield

(74) *Attorney, Agent, or Firm* — McCarter & English, LLP

(57) ABSTRACT

A system and method of constructing a composite floor system having increased shear transfer between a slab and support members of the system is described. The composite floor system may include any combination of the following elements: a support member, a reinforcing member, a transfer member, a decking material, a fastener, and/or a slab. The transfer member may be connected to the support member.

18 Claims, 18 Drawing Sheets

(56) References Cited

U.S. PATENT DOCUMENTS

| | | | | | |
|---|---|---|---|---|---|
| 3,036,347 | A | * | 5/1962 | Findleton | 403/217 |
| 3,094,813 | A | * | 6/1963 | Van Rensselaer | 52/344 |
| 3,177,619 | A | | 4/1965 | Benjamin | |
| 3,251,167 | A | | 5/1966 | Curran | |
| 3,537,221 | A | * | 11/1970 | Helfman et al. | 52/289 |
| 3,596,421 | A | | 8/1971 | Miller | |
| 3,683,580 | A | * | 8/1972 | McManus | 52/334 |
| 3,945,741 | A | * | 3/1976 | Wendt | 403/191 |
| 3,956,864 | A | | 5/1976 | Fung | |
| 4,005,942 | A | * | 2/1977 | Gilb | 403/189 |
| 4,106,249 | A | | 8/1978 | Morton | |
| 4,151,694 | A | * | 5/1979 | Sriberg et al. | 52/665 |
| 4,375,741 | A | * | 3/1983 | Paliwoda | 52/127.1 |
| 4,411,548 | A | * | 10/1983 | Tschan | 403/232.1 |
| 4,422,792 | A | * | 12/1983 | Gilb | 403/232.1 |
| 4,454,695 | A | * | 6/1984 | Person | 52/334 |
| 4,457,115 | A | | 7/1984 | Grearson et al. | |
| 4,566,240 | A | | 1/1986 | Schilger | |
| 4,602,467 | A | | 7/1986 | Schilger | |
| 4,653,237 | A | * | 3/1987 | Taft | 52/335 |
| 4,715,155 | A | | 12/1987 | Holtz | |
| 4,729,201 | A | | 3/1988 | Laurus et al. | |
| 4,741,138 | A | | 5/1988 | Rongoe, Jr. | |
| 4,785,600 | A | * | 11/1988 | Ting | 52/334 |
| 4,885,884 | A | | 12/1989 | Schilger | |
| 4,894,967 | A | * | 1/1990 | Morton | 52/334 |
| 4,909,007 | A | * | 3/1990 | Bodnar | 52/356 |
| 4,930,278 | A | | 6/1990 | Staresina et al. | |
| 5,367,848 | A | | 11/1994 | McConnohie | |
| 5,390,457 | A | | 2/1995 | Sjolander | |
| 5,414,972 | A | | 5/1995 | Ruiz et al. | |
| 5,544,464 | A | | 8/1996 | Dutil | |
| 5,564,248 | A | * | 10/1996 | Callies | 52/702 |
| 5,941,035 | A | * | 8/1999 | Purse | 52/263 |
| 6,216,414 | B1 | | 4/2001 | Feldberg | |
| 6,289,647 | B1 | | 9/2001 | Sjolander | |
| 6,463,711 | B1 | * | 10/2002 | Callies | 52/702 |
| 6,694,699 | B2 | * | 2/2004 | Dowland | 52/741.13 |
| 6,708,459 | B2 | | 3/2004 | Bodnar | |
| 6,729,094 | B1 | | 5/2004 | Spencer et al. | |
| 7,013,613 | B1 | * | 3/2006 | Boellner et al. | 52/837 |
| 7,174,686 | B1 | * | 2/2007 | Legband | 52/471 |
| 7,562,500 | B2 | * | 7/2009 | Siu | 52/236.6 |
| 7,779,590 | B2 | | 8/2010 | Hsu et al. | |
| 7,861,480 | B2 | * | 1/2011 | Wendelburg et al. | 52/483.1 |
| 8,230,657 | B2 | * | 7/2012 | Studebaker et al. | 52/414 |
| 8,245,480 | B2 | * | 8/2012 | Studebaker et al. | 52/655.1 |
| 2003/0009980 | A1 | * | 1/2003 | Shahnazarian | 52/712 |
| 2003/0093961 | A1 | * | 5/2003 | Grossman | 52/250 |
| 2004/0065404 | A1 | | 4/2004 | Furukawa et al. | |
| 2005/0120668 | A1 | | 6/2005 | Hage-Chahine et al. | |
| 2011/0000165 | A1 | * | 1/2011 | Glenn | 52/692 |

OTHER PUBLICATIONS

Metal Stud Crete, Composite Concrete Panel System—Quality Control and Fabrication Manual, Jun. 17, 2001, pp. 1-18.

* cited by examiner

SYSTEM AND METHOD OF USE FOR COMPOSITE FLOOR

CROSS-REFERENCE TO RELATED APPLICATIONS

This is a continuation-in-part of U.S. patent application Ser. No. 11/820,250, filed Jun. 19, 2007, now U.S. Pat. No. 7,779,590, which claims the benefit of U.S. Provisional Patent Application No. 60/815,340, filed Jun. 20, 2006, the disclosures of which applications are incorporated herein by reference in their entireties.

TECHNICAL FIELD

The present disclosure relates to the field of composite floor systems. More particularly, the present disclosure refers to systems and methods of constructing a composite floor system having increased shear transfer between a slab and support members of the system. Further, some embodiments of the systems and methods herein described may allow for increased load carrying capacity, increased resistance to deflection, increased ductility and/or increased potential energy absorption. In an exemplary embodiment, the disclosed system may reduce a weight of the system while maintaining strength and ductility of the composite floor system. Thus, the composite floor system described herein is lightweight and ductile. Further, the systems and methods described herein may allow for components of the composite floor system to be pre-fabricated off-site. In addition, exemplary embodiments of the disclosed composite floor system may use commonly available tools, materials and/or construction methods to reduce construction cost and provide other implementation-related advantages.

BACKGROUND OF THE INVENTION

For purposes of the present disclosure, the phrase "composite floor system" refers to a system that encompasses the use of multiple materials in the construction process of a floor system. Composite floor systems are designed to allow transfer of shear forces between the component parts of the deck and the supporting floor joists. Many composite floor systems combine wood, concrete and/or metals (e.g., steel).

Composite floor systems are commonly used in the construction of low-rise multifamily housing, commercial, mixed use developments and/or hospitality projects. Composite floor systems are designed to allow the component parts to act in conjunction with each other to increase the load capacity of the system and reduce the total deflection under load. Concrete-steel composite floor systems are preferred in construction projects, particularly where wood is scarce. However, the abundance of wood in North America has made wood the traditional floor material in both the United States and Canada.

Non-composite floor systems may require an increase in material and size to provide the same load carrying capacity as is delivered by a composite floor system. Due to this increased strength relative to non-composite floor systems, composite floor systems are frequently utilized in areas subject to heavy floor loads and where significant unanticipated forces may be encountered, for example, areas prone to natural disasters (e.g., earthquakes) and military installations.

Current building technology includes many configurations for conventional composite floor systems. FIG. 1 and FIG. 2 depict views of non-composite floor systems. FIG. 1 illustrates a top view of a non-composite floor system which includes a decking material "D" and fasteners "F". FIG. 2 depicts a cross-sectional side view of a non-composite floor system which includes the decking material "D", a reinforcing member "R", a slab "S", and a beam "B".

Traditional composite floor systems require decking which is often limited to one particular type. Further, many currently available floor systems use discontinuous slabs of concrete due to design constraints. In addition, traditional composite floor systems generally require use of significant temporary formwork. In some instances, traditional composite floors may use complicated shear connectors to foster composite action from the component parts of the composite floor. These complicated shear connectors increase cost and may significantly affect installation requirements and time, which in turn translates into higher construction costs per square foot of installed floor.

The presently disclosed novel apparatus and method of use offer the advantages present in traditional composite flooring systems/techniques, but eliminate the associated disadvantages.

SUMMARY

A composite floor system and method of construction thereof are herein described. The method and system described herein may allow components of the system to be assembled prior to delivery to the work site. Thus, the design of the composite floor system may facilitate a reduced assembly time on-site and reduced costs of construction. The design of the composite floor system described herein may further decrease costs associated with assembling the composite floor system on-site by the use of common tools, construction methods, and lightweight materials that can be easily transported around the job site.

A method of constructing a composite floor system as herein described may include assembling one or more components prior to delivery to the site. For example, a decking material may arrive on a construction site coupled to a transfer member. This may reduce building costs on-site as well as provide for a more stable system.

An exemplary composite floor system embodiment of the present disclosure includes lightweight materials, which may be easily fabricated and are economical. In addition, a lightweight composite floor system may be easier to handle and transport. In some embodiments, the composite floor system and method of construction described herein may minimize the need for sophisticated quality control measures to achieve a desired or intended load capacity.

In an exemplary embodiment, the composite floor system may include a combination of one or more of the following elements: a support member, a reinforcing member, a transfer member, a decking material, a fastener and/or a slab. In alternate embodiments, elements of the composite floor system may vary. In addition, the system and the component parts may be installed easily with readily available hardware and tools.

A lightweight composite floor system, as described herein, may serve as an alternative to wood-based floor systems. The composite floor system described herein may provide for greater structural strength and a higher fire-rating as compared to a wood-based system. In addition, the disclosed composite floor system may provide better soundproofing than a wood-based system. Further, the composite floor system and method described herein may also serve as an alternative to other steel-based composite floor systems. The floor system described herein may have a lower material cost per square foot than non-composite floor systems and enable a reduction in the profile of the composite floor, thus reducing the height of the floor. Further, a transfer member described herein may increase the overall stability of the composite floor system when compared to conventional systems, e.g., wood-based, traditional steel-based, non-composite floor systems, or traditional composite floor systems.

Further, the system described may have an increased load carrying capacity, an increased resistance to deflection, increased ductility, and/or an increase in potential energy absorption of the system relative to non-composite floor systems and/or traditional composite floor systems. In some embodiments, the design of the described system may reduce weight of the system while maintaining strength of the composite floor system. Thus, the composite floor system described herein is lightweight. Further, the system and method described herein may allow for components of the composite floor system to be pre-fabricated off-site. An embodiment of the disclosed composite floor system may use commonly available tools and construction methods to reduce construction cost for the system and method.

In one embodiment, the composite floor system includes a slab, a deck material sized and shaped to support the slab, a support member attached to the deck material, and a transfer member, such as a shear connector. The transfer member is attached to the support member. The transfer member includes an elongated body having a bottom with a pair of opposing edges, an open top opposite the bottom, and side walls extending upwardly from each edge. The transfer member is adapted to increase transfer of shear forces between the slab and the support member.

Alternatively, the transfer member may define cutouts in the bottom and/or side walls that are sized to cooperate with the profile of the deck material. Cooperation between the cutouts, which may be punched into the transfer member, and the deck material permit the transfer member to fit effectively across the deck material and establish a tight interaction with the bottom of the deck, thereby allowing direct connection to the support member. This configuration advantageously establishes a continuous deck material, wherein the transfer member straddles the profile of the deck material for an advantageous fit of transfer member, deck material and support member. As noted previously, the transfer member is adapted to increase transfer of shear forces between the slab and the support member.

In another embodiment, the composite floor system includes a slab, a deck material sized and shaped to support the slab, a support member attached to the deck material, and a transfer member attached to the support member. The support member includes a first beam with a first side wall having a first top edge and a first bottom edge. The first beam includes a first flange extending from the first top edge of the first side wall. The support member also includes a second beam with a second side wall having a second top edge and a second bottom edge. The second beam includes a second flange extending from the second top edge of the second side wall. The first side wall is positioned proximate the second side wall.

In another embodiment, a continuous cold-formed shear connector is seated directly on the top flanges of cold-formed metal joists through welding or bolting. A structural gap is created between the cold-formed shear connector and the cold-formed metal joists. The composite floor system is made by cold-formed and light weight materials to provide a structural continuity of continuous shear connector and metal joists.

These and other advantages, features and attributes of the herein described composite floor system and its advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein.

DESCRIPTION OF EXEMPLARY EMBODIMENTS

A composite floor system may include two or more components to allow for transfer of shear forces between the component parts. In some embodiments, multiple components may act as a unified object. Components used in the composite floor system may include lightweight materials, to decrease a total weight of the system while maintaining the strength and durability of the floor system.

Figure 1:
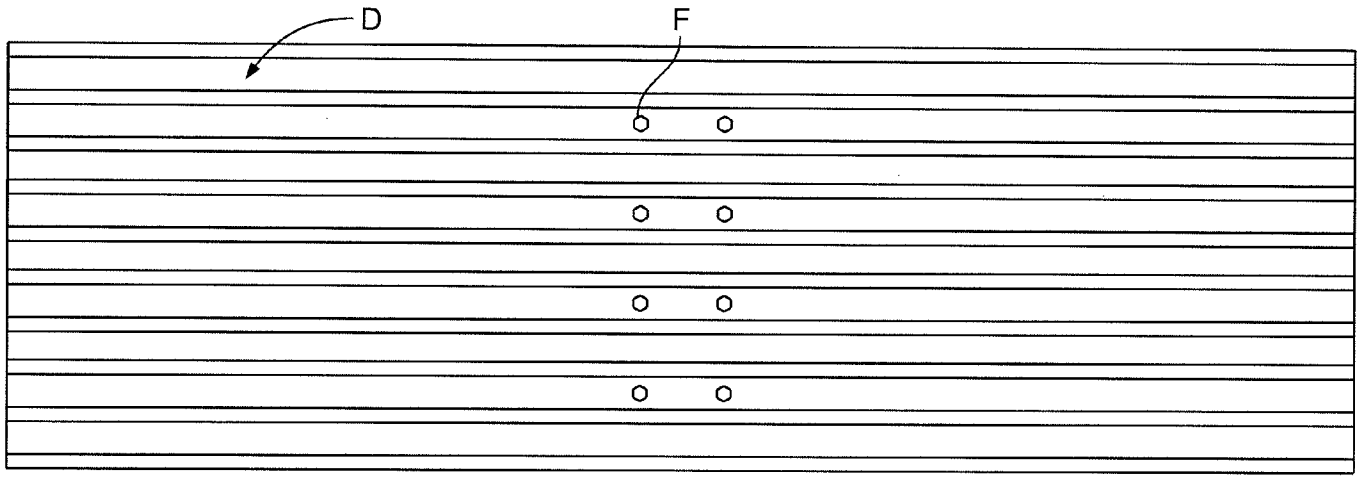
FIG. 1 (Prior Art)
FIG. 1 depicts a top view of a non-composite floor system.
Figure 2:
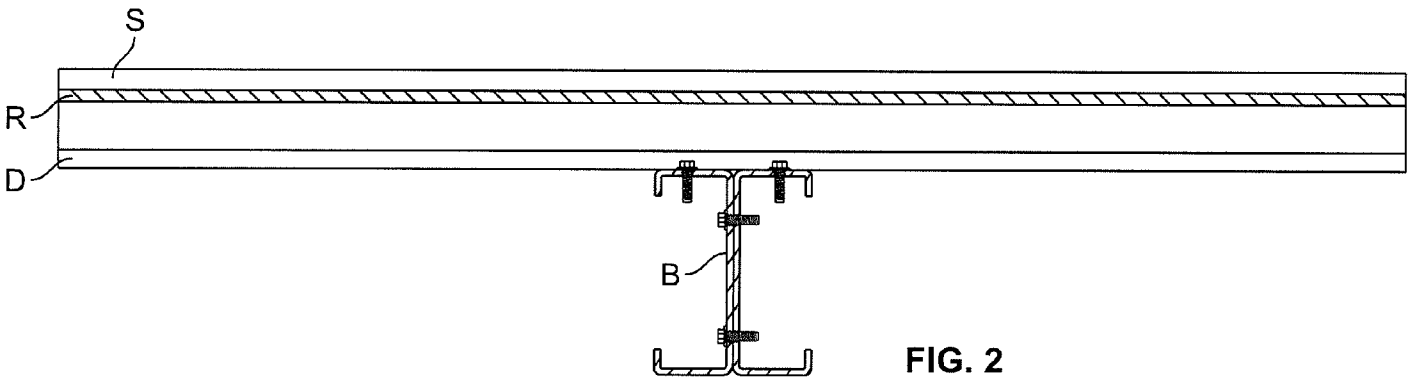
FIG. 2 (Prior Art)
FIG. 2 depicts a cross-sectional side view of a non-composite floor system.
Figure 3:
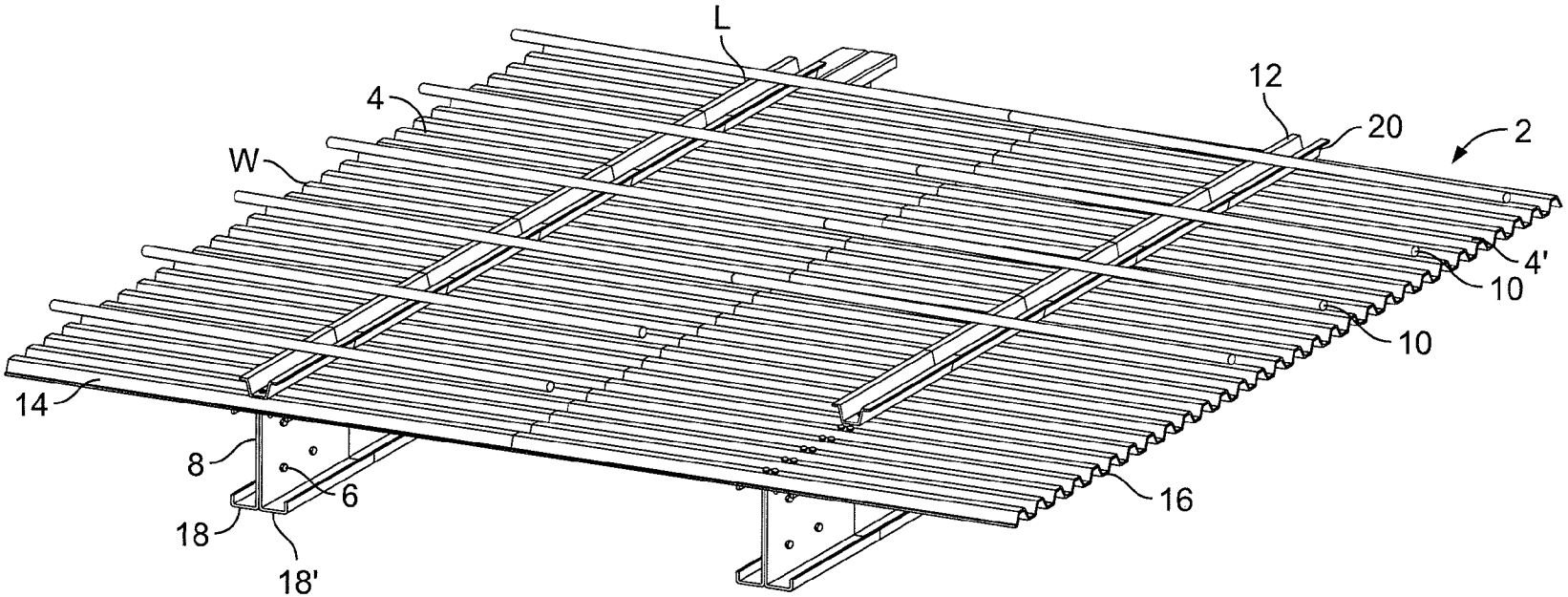
FIG. 3 depicts a perspective view of an embodiment of a composite floor system.

FIG. 3 depicts an embodiment of composite floor system 2 prior to the addition of a slab. In this embodiment, composite floor system 2 includes decking material 4, 4' fasteners 6, support members 8, reinforcing members 10, transfer members 12, and a slab (not shown).

Decking material 4 may include various materials including, but not limited to wood, plywood, fiberboard, metal, corrugated sheet metal, sheet metal (e.g. cold form steel), pre-cast concrete materials, gypsum, GYP-CRETE® underlayment, gypsum-metal composites, backer boards, rubber padding, fiberglass, polymer sheets, foam-core panels, and/or any combination thereof. In some embodiments, the decking material may have a rough surface. In alternate embodiments, a surface of the decking material may be relatively smooth or have a smooth surface.

Decking material 4 may have any thickness, weight, and shape. In some embodiments, the weight of decking material 4 may be minimized in order to minimize the weight of the composite floor system. As shown in FIG. 3, decking material 4 is a corrugated sheet metal having peaks 14 and valleys 16. Decking material 4 may be used to support the slab.

Fasteners 6 are used to couple the component parts. FIG. 3 depicts fasteners 6 coupling two beams 18, 18' to form support member 8. Fasteners may include, but are not limited to screws, rivets, welds, bolts, anchors, clips, straps, wires, cables, adhesives, and/or any method of coupling known in the art. Fasteners may be coupled to transfer members, support members and/or decking materials using any fastening systems including, but not limited to a nail gun or any type of power actuated fastener installer hardware machine. For example, a metal deck fastening system from Hilti Corporation (Tulsa, Okla.) may be used.

As shown in FIG. 3, support member 8 includes two C-beams 18, 18' coupled together. Beams used as support members may have any cross-sectional geometry. In another embodiment, support members may be constructed from one or multiple materials including, but not limited to metals (e.g., light-gauge steel, cold-formed steel, aluminum, alloys), fiberglass, engineered lumber, composites, concrete, reinforced concrete, wood, and/or masonry. Further, support members may include, but are not limited to, one beam (e.g., an I-beam, a C-beam, an X-beam, a V-beam, a T-beam, an L-beam, a Z-beam, a hollow structural beam or any other shape that may be configured to act as a main supporting beam), a coupling of multiple beams, girders, joists, studs, trusses, walls (e.g., concrete walls, masonry walls), and/or any combination thereof. Support members may be solid or, in some embodiments, the support member may have openings to reduce its weight. An embodiment of a support member may be constructed to withstand high compressive forces. For example, a support member may be designed to deform under a compressive force to prevent buckling.

As illustrated in FIG. 3, reinforcing members 10 are reinforcement bars (e.g., "rebars"). In some embodiments, reinforcing members include, but are not limited to bars, grids, fibers, and/or cables. Reinforcing members may be constructed from materials including, but not limited to steel, plastics (e.g., fiber-reinforced plastics), composites, fiberglass, and/or any other type of tensile reinforcing material. In some embodiments, the reinforcing members may be placed proximate the transfer member and/or the decking material. Alternatively, one or more of the reinforcing members may be coupled to the transfer member and/or the decking material.

Composite floor system 2 includes transfer member 12 having transfer member flanges 20. Transfer members 12 may be formed from any material including, but not limited to metals (e.g., light gauge steel, cold-form steel, alloys, etc.), polymers, composites, and/or any combination thereof. In some embodiments, transfer members 12 may be formed from sheet materials. In alternate embodiments, transfer members 12 may be formed using an extrusion process. In addition, some embodiments may include transfer members constructed from commonly available materials, including, but not limited to joists, channels, and/or troughs. For example, a furrowing channel may be used as a transfer member. Transfer members 12 may also include cutouts, e.g., formed in parts of the bottom and/or side walls, that are configured and dimensioned to cooperate with the profile of the deck material, thereby allowing for a tight/perfect fit between the deck member and transfer member.

Figure 4:
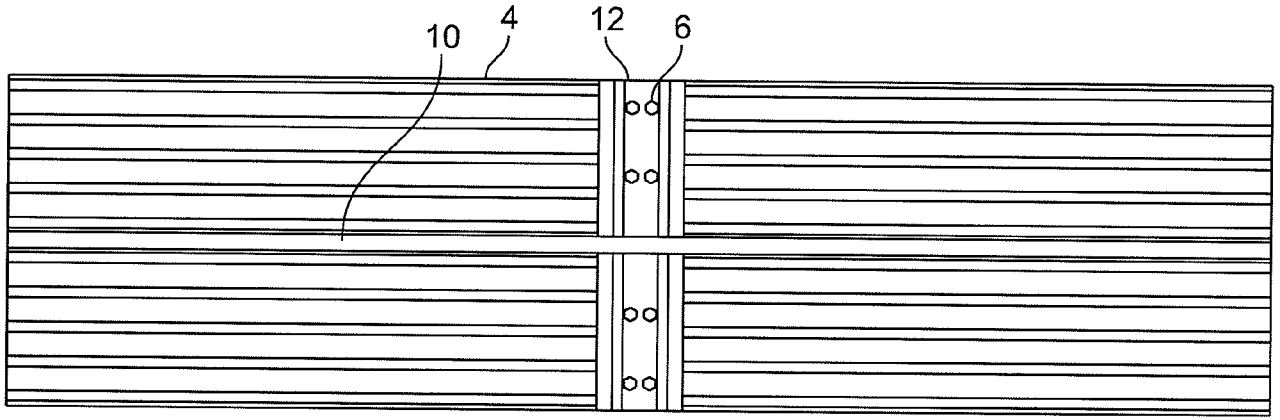
FIG. 4 depicts a top view of an embodiment of a composite floor system.
Figure 5:
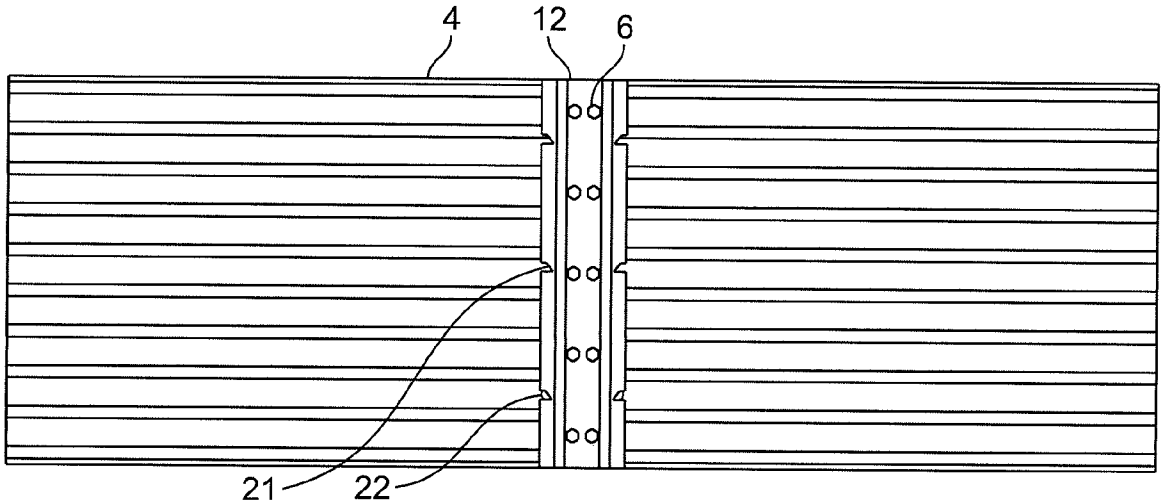
FIG. 5 depicts a top view of an embodiment of a composite floor system.

FIG. 4 and FIG. 5 illustrate a layout of fasteners 6 for coupling the transfer member 12 to decking material 4 and a support member (not shown). In some embodiments, the positioning of fasteners 6 in combination with use of the transfer member 12 may increase shear transfer from the slab to the support member 8.

Figure 6:
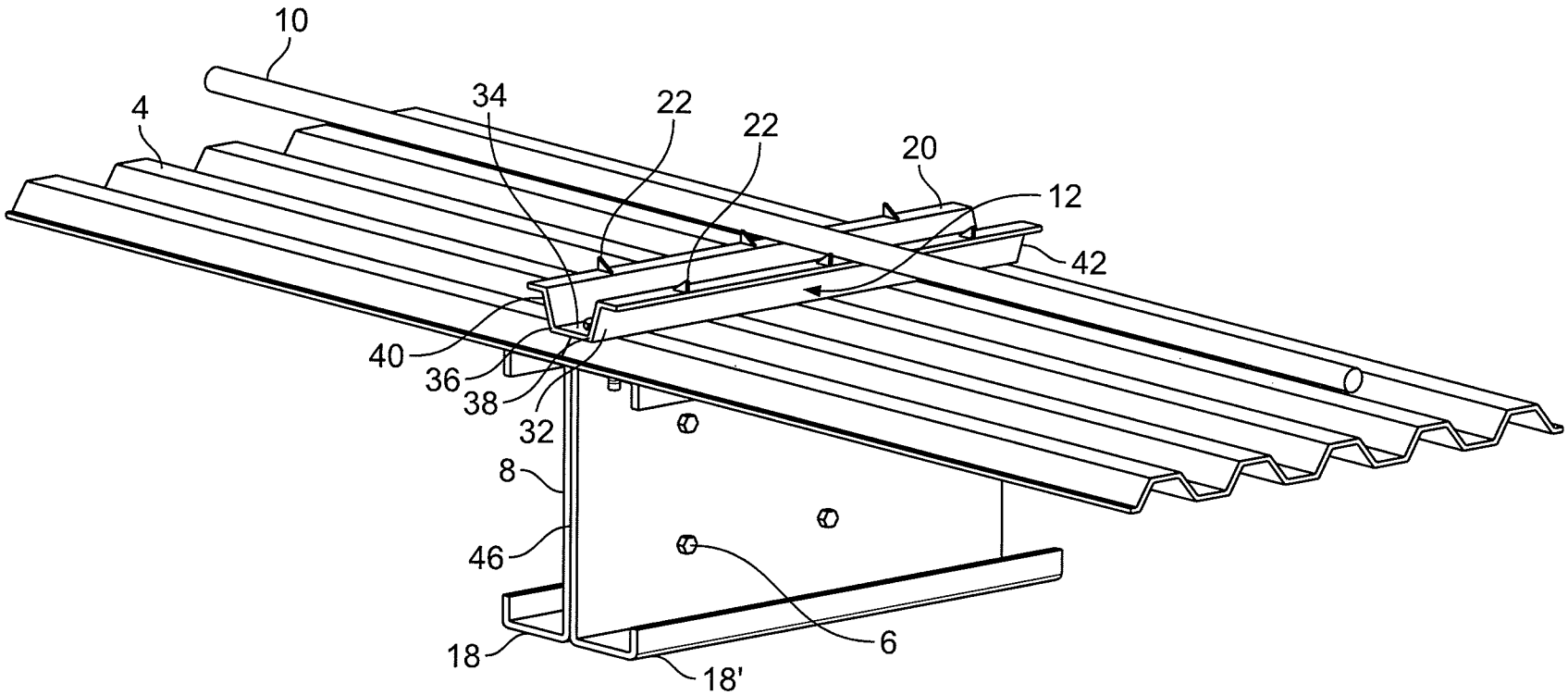
FIG. 6 depicts a perspective view of an embodiment of a composite floor system.

As shown in FIG. 5 and FIG. 6, transfer member 12 may include cuts 21 and/or folds 22. Cuts 21 and folds 22 may increase the contact area between the transfer member and the slab (not shown). In alternate embodiments, transfer member may include one or multiple protrusions or openings to increase transfer of shear forces between the slab and the support member. Openings may be punched into the transfer member on-site during assembly or prior to delivery on-site. The transfer member can facilitate in distributing the transferring mechanism of horizontal shear force. The transfer member could include a plurality of triangular cuts formed along the longitudinal axis of one flange of the transfer member. Also, the folds could be positioned along the longitudinal axis of one flange of the transfer member.

Figure 7:
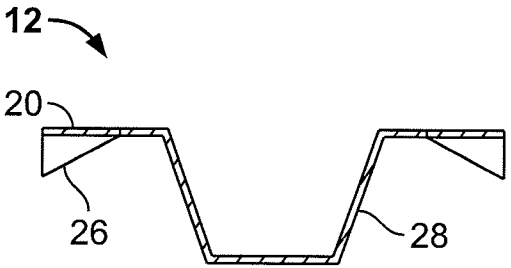
FIG. 7 depicts a cross-sectional view of an embodiment of a transfer member.
Figure 8:
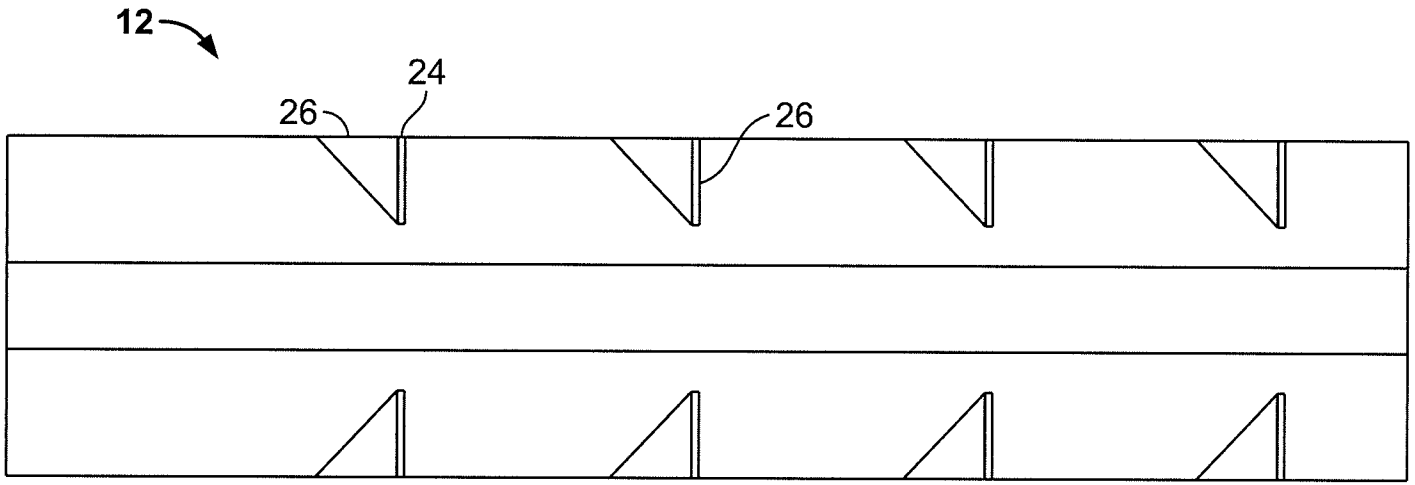
FIG. 8 depicts a top view of an embodiment of a transfer member.
Figure 9:
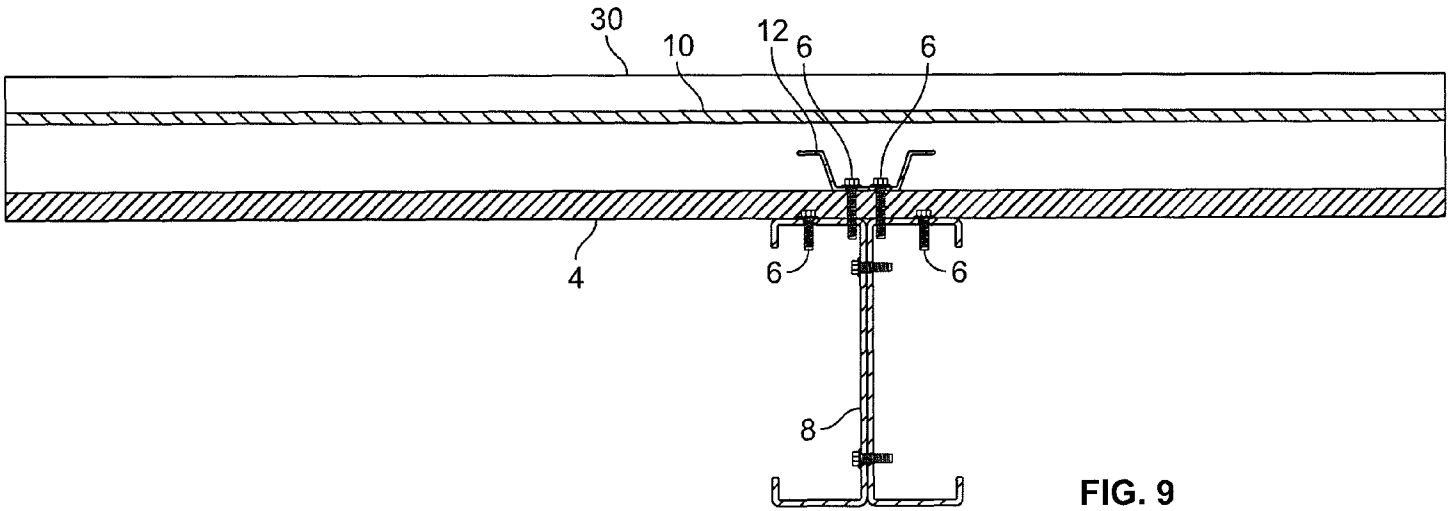
FIG. 9 depicts a cross-sectional side view of an embodiment of a composite floor system.

As shown in FIG. 7 and FIG. 8, transfer member flanges 20 include pre-cuts 24, such that portions 26 of transfer member flange 20 may be bent up or down. In some embodiments, portions 26 may have any shape. The shape of transfer member flanges 20 may vary. Transfer members may have any surface including, but not limited to a rough surface, a smooth surface, or a combination thereof. The pre-cuts could be positioned along the longitudinal axis of one flange of the transfer member so as to allow the flange to bend vertically.

FIG. 7 illustrates transfer member 12 having trough 28 and transfer member flanges 20. In alternate embodiments, a section of the transfer member may have a cross-sectional profile of a V-shape, a V-shape with a flat bottom, a U-shape, a W-shape or any other shape commonly known in the art. In some embodiments, transfer member flanges 20 are continuous along the length of transfer member 12. Alternately, transfer member flanges 20 may run for a discreet length of transfer member 12.

FIG. 9-12 demonstrate use of composite floor system 2. Slab 30 surrounds sections of transfer member 12 as shown. As shown, the slab 30 may be formed from concrete. In an embodiment, a slab may be formed from concrete, gypsum, GYP-CRETE® underlayment, a composite, fiberglass, plastic, any material that can flow and set, or any material known in the art.

In some embodiments, the transfer member 12 is coupled to the decking material 4 and support member 8 to increase transfer of shear forces between the slab 30 and the support member 8. The transfer member 12 may increase transfer of shear forces between the slab 30 and the support member 8 due to a continuous part of the transfer member 12 embedded in the slab 30. Thus, the composite floor system 2 may be able to withstand higher bending moments and sustain less deflection than expected for traditional composite systems or non-composite systems.

In an embodiment, the transfer member 12 is situated on top of the decking material 4 in the same direction as the support member 8. The transfer member 12 has a length L (see FIG. 3) that is the same or substantially the same as the width W of the decking material 4. Thus, the transfer member 12 is continuous across the top of the decking material 4.

The transfer member may be any conventional furring channel, such as the furring channel made by Allied Building Products Corp., East Rutherford, N.J. The transfer member may have any suitable height, such as a height of ⅞ inches.

With reference to FIG. 6, the transfer member 12 can include an elongated body 32 having a bottom 34 with a first edge 36 and a second edge 38 opposite the first edge 36. Also, the transfer member 12 can include an open top opposite the bottom 34, a first side wall 40 extending upwardly from the first edge 36 of the bottom 34, and a second side wall 42 extending upwardly from the second edge 38 of the bottom 34. The flanges 20 extend from each of the first and second side walls 40, 42.

Figure 10:
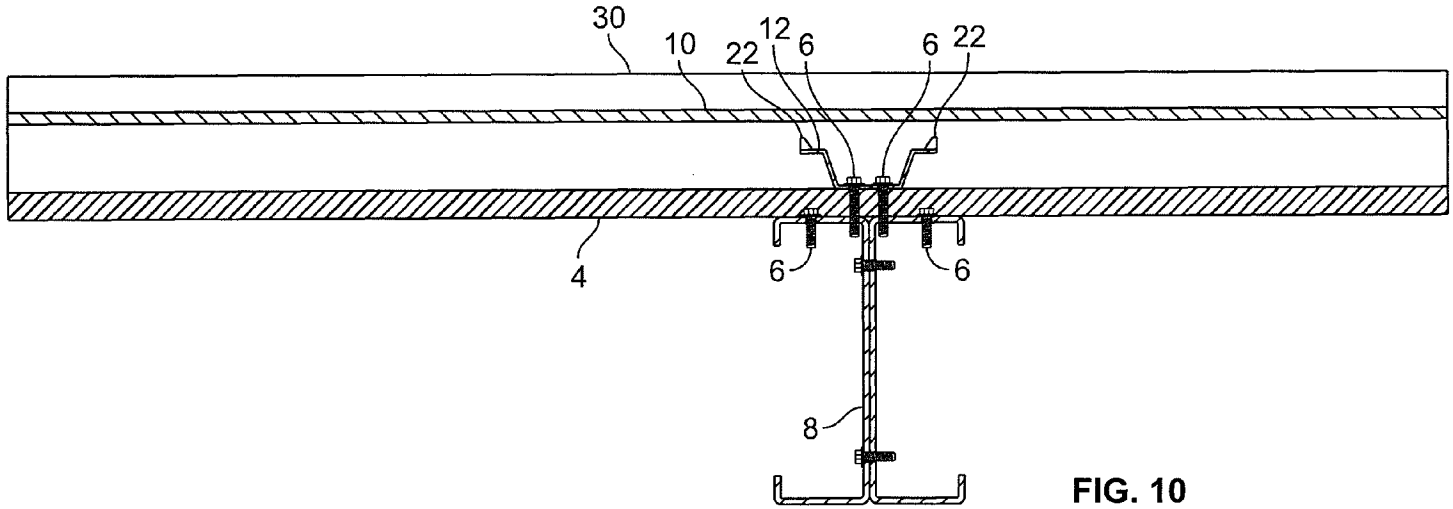
FIG. 10 depicts a cross-sectional side view of an embodiment of a composite floor system.
Figure 11:
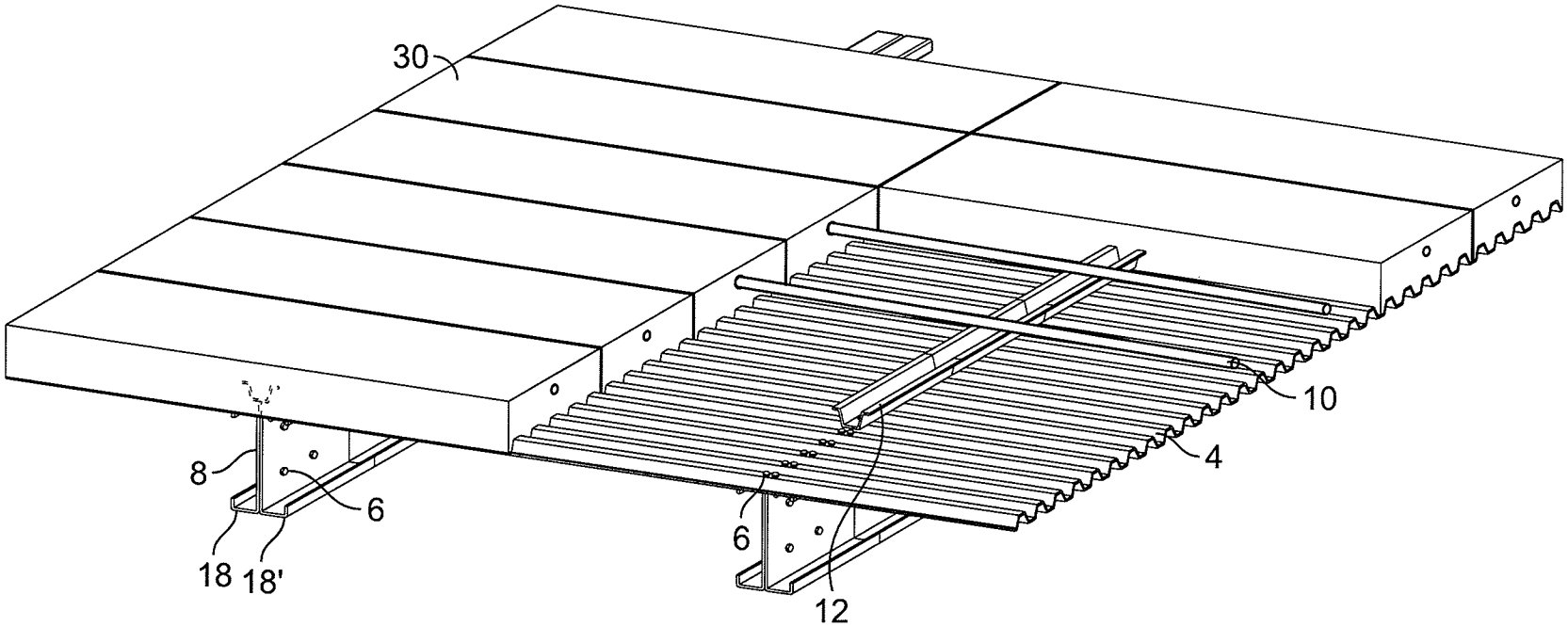
FIG. 11 depicts a perspective view of an embodiment of a composite floor system with an associated slab.
Figure 12:
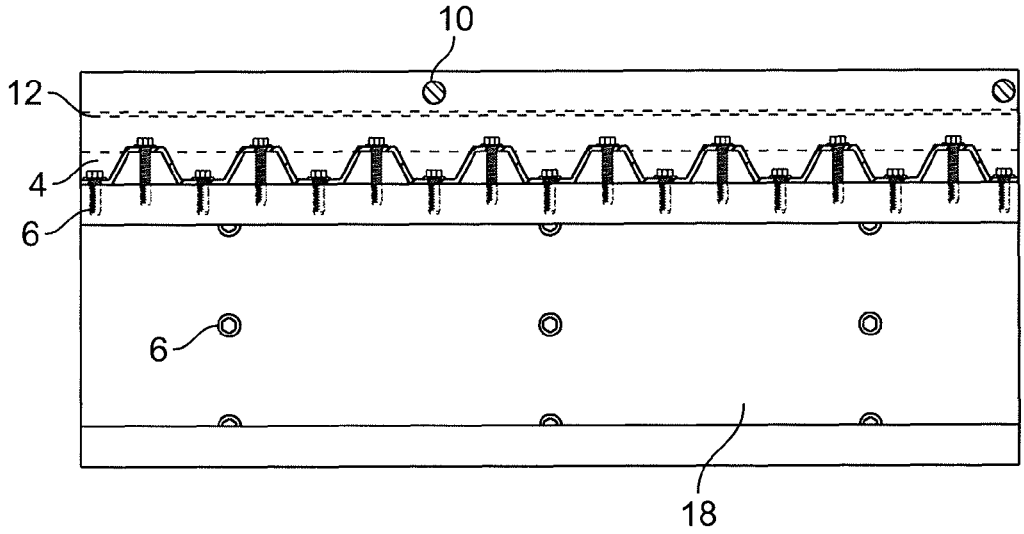
FIG. 12 depicts a cross-sectional side view of an embodiment of a composite floor system.

As shown in FIG. 10, an alternate embodiment may include a transfer member with cuts 21 and folds 22. In some embodiments, a shape of transfer member flange 20 in combination with cuts 21 and folds 22 may achieve full bearing of the transfer member 12 with the slab 30. In an alternate embodiment, transfer member flanges may be shaped to allow for an increase in transfer of shear forces. For example, the shape of the transfer member flange may be irregular having wider or narrower sections. Alternately, a transfer member flange may include protrusions and/or cut-outs. Bending and deflection characteristics of the herein described composite floor system may be improved due to the described configuration when compared with non-composite floor systems.

In alternate embodiments, the reinforcing member 10 may be coupled to the slab 30 (e.g., a concrete deck) to increase shear load transfer between the slab 30 and the support member 8. The reinforcing member 10 may be coupled to the support member 8, the transfer member 12 and/or the decking material 4 while a continuous portion of the reinforcing member 10 may be embedded in the slab 30.

Figure 13:
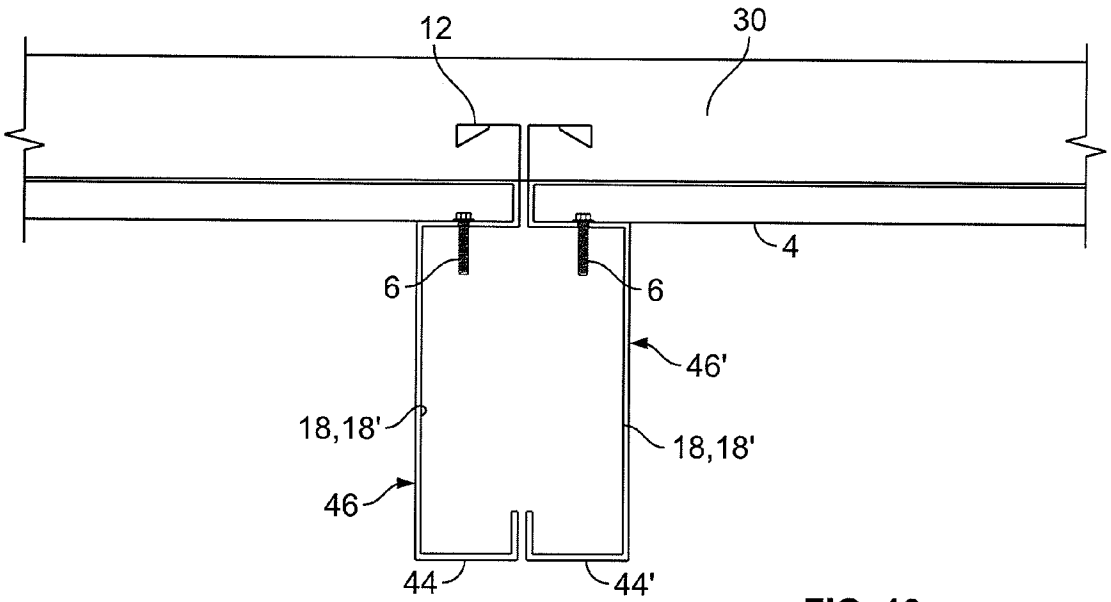
FIG. 13 depicts a cross-sectional side view of an embodiment of a composite floor system.

FIG. 13 depicts an embodiment wherein the beams 18, 18' of the support member 8 are coupled together at flanges 44, 44'. The beams 18, 18' include webs 46, 46' facing outward. The resulting cross-sectional geometry resembles a rectangle.

Figure 14:
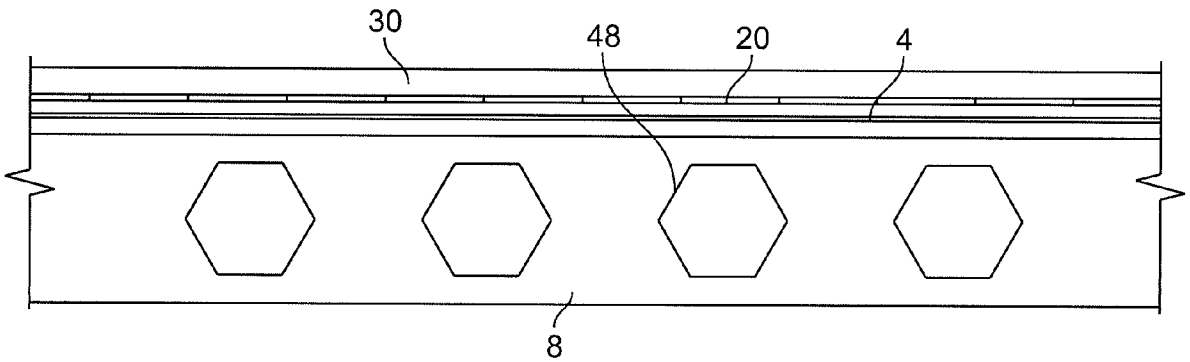
FIG. 14 depicts a cross-sectional side view of an embodiment of a composite floor system.

FIG. 14 depicts a schematic of a side view of a composite floor system. Support members 8 may include openings 48 to reduce the weight of the support member and also the composite floor system. Openings may have any shape, size, or configuration. In some embodiments, multiple openings may be positioned at intervals along the support member.

In some embodiments, component parts of the composite floor system may be coupled to each other on a construction site. For example, in some embodiments a method of constructing a composite floor system may include coupling two beams (e.g., cold-form steel beams) together with 1 inch self-drilling fastening screws using an electric impact torque wrench to form a support member. The screws may be any size or shape, such as a self-drilling fastening hex screw #10-16¾" 0.19 inch diameter. In some embodiments, the beams may be coupled together to allow webs 46, 46' of beams 18, 18' to be positioned proximate each other as shown in FIG. 6. The top flange and bottom flanges of the two beams may be on the same plane. Screws may be positioned in two rows along a span of the beam. Each row of screws may be positioned one inch from the top flange and one inch from the bottom flange of the steel beams. In some embodiments, screws may be positioned along the beam at discrete distances from each other. For example, screws may be positioned having a one-foot spacing between the screws along the beam span.

An embodiment may include positioning a decking material, such as a cold form steel deck, on the top of the assembled support member. As shown in FIG. 3, peaks 14 and valleys 16 of decking material 4 may be positioned perpendicular to support member 8. Alternately, the peaks 14 and valleys 16 may be positioned in parallel with the support member. In some embodiments, peaks 14 and valleys 16 may be positioned such that they form an obtuse or acute angle with a vertical plane through support member 8. Proximate pieces of decking material 4, 4' may overlap as FIG. 3 illustrates. In some embodiments, overlapping decking materials may be coupled together using one or multiple fasteners. Distances between the fasteners may vary according to the application. For example, one-inch self-drilling fastening screws may be used to couple overlapped form decks spaced at one-foot intervals along the length of the deck ribs. In some embodiments, proximate pieces of decking material may be positioned such that peaks 14 and valleys 16 correspond. In some embodiments, a continuous slab may require multiple pieces of decking material.

A portion of the decking material may be coupled to a support member with any type of coupling method known in the art or described herein. For example, decking material may be coupled to a support member at a valley of decking material with screws. Alternately, decking material may be coupled to support members at any location on the decking material. In some embodiments, screws or any type of fastener may be positioned at a specific distance from a centerline of the support member (e.g., 0.25 inches from the centerline of the beam). Further, screws may be positioned along a span of the beam at regular or irregular intervals. For example, screws may be positioned along the beam span at 2.5 inch intervals. The screw can be any suitable size or shape, such as a self-drilling fastening hex screw #10-16¾" 0.19 inch diameter.

An embodiment may include placing a transfer member on top of the decking material such that a centerline of the transfer member corresponds to a centerline of the support member. The transfer member may be coupled to the support member using fasteners. Fasteners may be positioned such that the fasteners are offset from a centerline of the support member and are positioned at intervals along the span of the support member. For example, a transfer member may be positioned on top of a steel deck and coupled with two-inch self-drilling screws. The screws may be located at 0.25 inches from the centerline of beam. The screws may be positioned at 2.5 inch intervals along the span of the beam. The screws can be any suitable size or shape, such as a self-drilling fastening hex screw #12-14-2" 0.21 inch diameter. In alternate embodiments, a centerline of the transfer member may be positioned perpendicular to a centerline of the support member. An embodiment may include positioning the centerline of the transfer member at either an acute or obtuse angle with respect to the centerline of the support member.

In some embodiments, reinforcing members may be positioned proximate the transfer member. Reinforcing members may be positioned perpendicular to the centerline of the support member. Alternately, reinforcing members may be positioned parallel to or at an acute or obtuse angle with respect to the centerline of the support member. For example, in one embodiment rebar may be used as reinforcing members and the decking material may be a steel sheet with ribs. In an embodiment, rebar may be positioned 2 inches from the bottom of a rib and perpendicular to the support member.

An embodiment may include pouring a slab into the herein described composite floor system. For example, concrete may be poured onto the decking material. The slab may have a thickness sufficient to cover decking material, a transfer member and/or a reinforcing member. In some embodiments, a thickness of the slab may be approximately 3 inches. In some alternate embodiments, the thickness of a slab may vary according to the requirements of the application. In some embodiments, a slab may be covered after being poured to minimize water evaporation to allow the slab to cure.

In an embodiment, portions of a composite floor system as herein described may be pre-fabricated prior to delivery to the site. Pre-fabrication of portions of the composite floor system may reduce building costs on-site as well as provide for a more consistent quality in the building process. For example, decking material may arrive on a construction site coupled to a transfer member. Pre-fabrication may allow for more consistent coupling of the component parts, whether the method of coupling is a screw, a bolt, a rivet, a weld (e.g. a spot-weld), a nail, a strap or any other method of coupling known in the art. Alternately, reinforcing members may be coupled to decking material and transfer members prior to delivery to the site. Further, support members may be formed prior to delivery on-site. For example, two beams may be coupled together to form a support member prior to delivery on-site.

Figure 15:
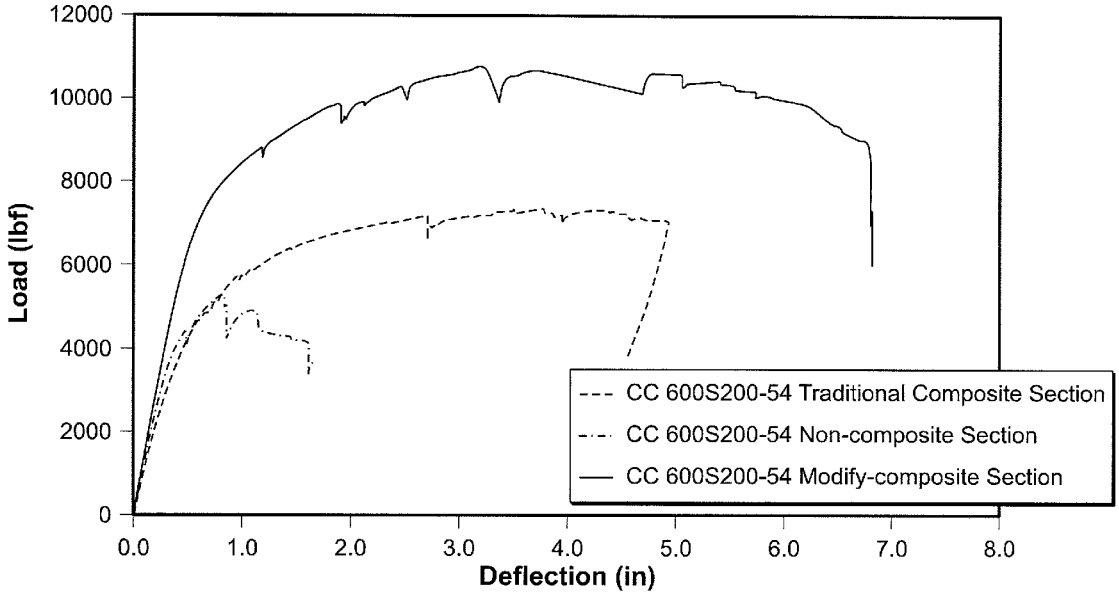
FIG. 15 is a schematic depicting the load deflection values for a composite floor system, a non-composite floor system, and a modified composite floor system.
Figure 16:
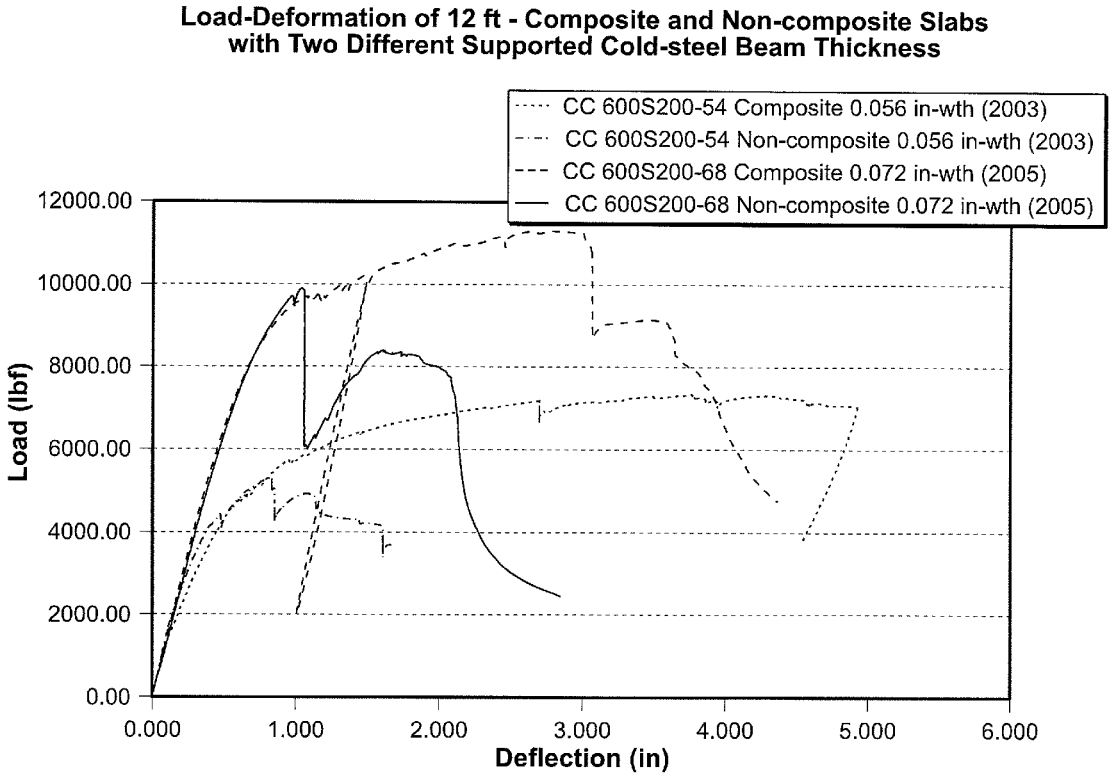
FIG. 16 is a schematic depicting the load deflection values for composite floor systems and non-composite floor systems having support members of different thicknesses.
Figure 17:
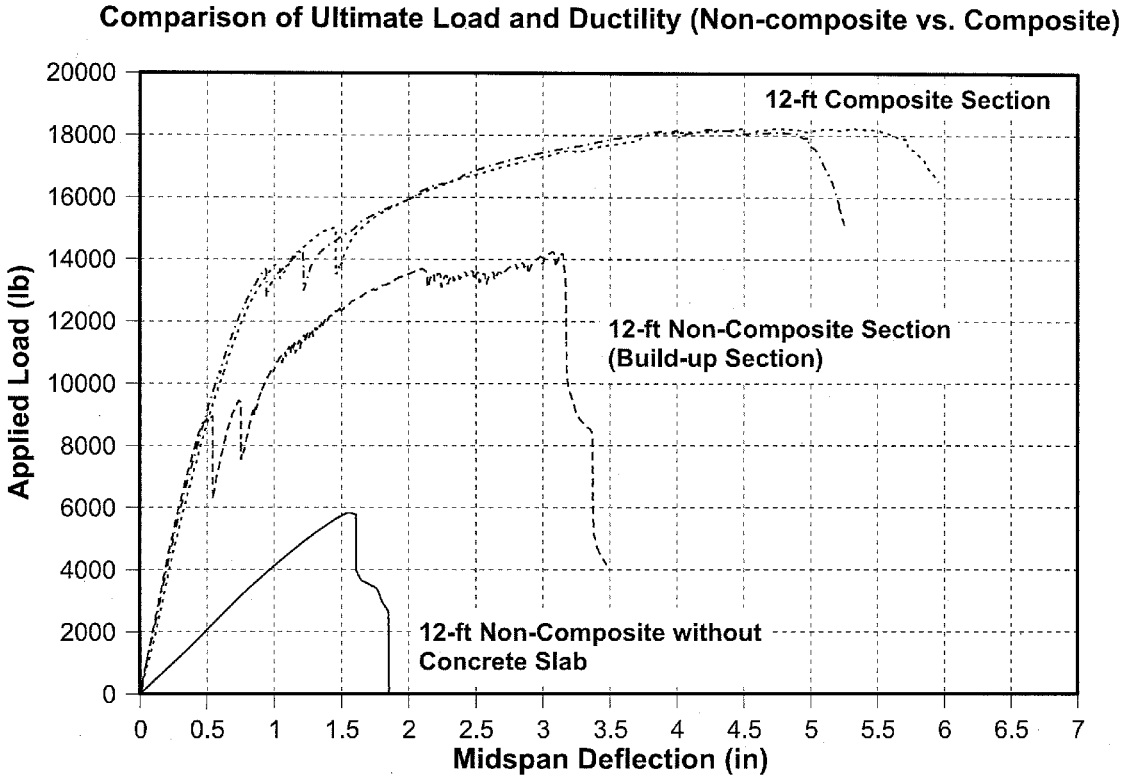
FIG. 17 is a schematic depicting the mid-span deflection values for a composite floor system and a non-composite floor system.

The method and system described herein provides a composite floor system, which in some embodiments, may be constructed from readily available material and using readily available tools. The combination of components in the composite floor system provides for a strong, resilient and ductile floor system. The symmetry in the design of the composite floor system may allow the floor system to withstand larger forces and increase the ductility of the system described herein over floor systems commonly known in the art. FIG. 15 depicts a graph of applied load to deflection for a traditional composite system, a non-composite system, and a composite floor system as described herein. As is evidenced in the graph, the composite system described herein can withstand large loads and sustain smaller deflections than comparable traditional composite or non-composite floor systems. FIG. 16 depicts a graph of applied load to deflection values measured for the herein described system and method and a non-composite floor system having varied support member thicknesses. From the data presented in the graph, it appears that the composite floor system and method described herein may withstand greater applied loads than comparable non-composite floor systems. FIG. 17 depicts a graph of applied load to mid-span deflection values measured for a composite floor system as described herein and a non-composite floor system. According to the data presented in the graph of FIG. 17, the composite system described herein can withstand greater applied loads and has greater ductility than comparable non-composite floor systems.

The composite system described herein is a scalable entity. The dimensions of the components of the composite system can be altered.

The following description will describe a method for assembling the composite system 2. Initially, two cold-formed steel joists, such as the C-beams 18, 18', are attached to each other with 1 inch (25.4 mm) self-drilling fastening screws using an electric impact torque wrench. More particularly, the screws are positioned at one row approximately one inch from the top web, and at another row approximately one inch from the bottom web. Each row has one foot spacing along the beam span.

A cold-formed steel decking material is placed on the top of the beams such that the decking material 4 is perpendicular to the beams. 1 inch (25.4 mm) self-drilling fastening screws are used to connect portions of the decking material that overlaps with other portions of the decking material 4. The rib of the decking material is fastened to the beams with two 1 inch self-drilling screws. Each screw is located at 0.25 inches (6.35 mm) from the centerline of the beam. The next set of screws is located at 2.5 inches (63.5 mm) from the first set of screws or the spacing of the bottom rib of the decking material. The remaining screws are placed following the above series along the beam span.

The shear connector, such as the transfer member 12, is placed on top of the decking material 4. The location of the shear connector should be on the center line of the beam. The shear connector is fastened to the beam with two 2 inch (50.8 mm) self-drilling screws. Each screw is located at 0.25 inches (6.35 mm) from the centerline of beam. The location of the next set of screws is designated by the spacing of the top rib of the decking material 4 or 2.5 inches (63.5 mm) along the beam span.

A number 2 or 3 rebar, such as the reinforcing member 10, is placed on the shear connector to prevent transverse cracking in the slab. The rebar is located 2 inches (50.8 mm) from the bottom rib. The direction of the rebar is perpendicular to the beam span. The rebar is spaced one foot along the span.

Concrete that is approximately 3 inches thick (76.2 mm) is then placed on the decking material. The concrete is immediately covered after casting to avoid any water evaporation.

Figure 18:
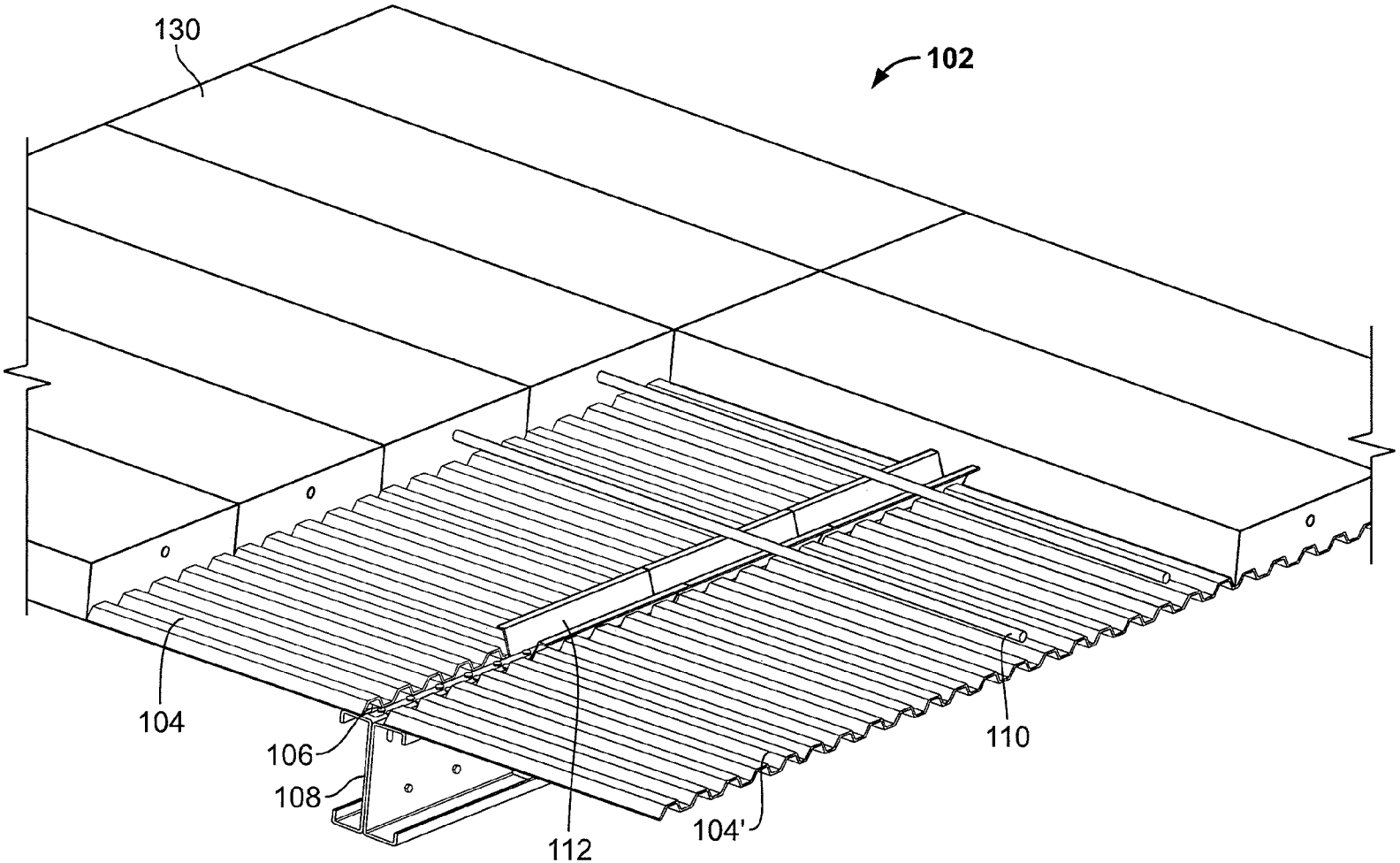
FIG. 18 depicts a perspective view of an embodiment of a composite floor system with an associated slab.
Figure 19:
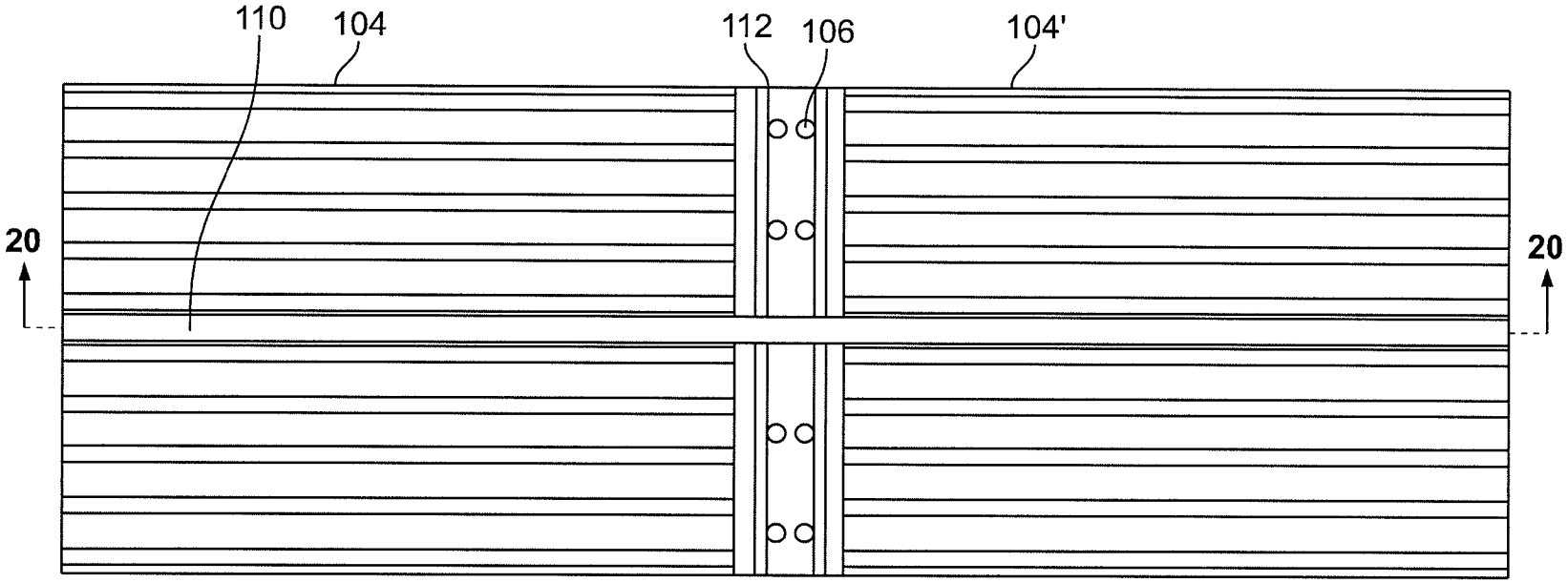
FIG. 19 depicts a top view of an embodiment of a composite floor system.

As shown in FIGS. 18 and 19, an alternative embodiment of a composite floor system, indicated generally as 102, is provided. The composite floor system 102 includes decking materials 104, 104', a fastener 106, support members 108, a reinforcing member 110, a shear connector, such as a transfer member 112, and a slab 130. The transfer member 112 is sized to fit between a gap formed between adjacent decking materials 104, 104'.

With further reference to FIGS. 18 and 19, an alternative implementation of the disclosed composite floor system 102 is contemplated wherein the decking material 104 is continuous, i.e., there is no discontinuity in the decking material as depicted in FIGS. 18 and 19 by discrete decking materials 104, 104'. Rather, transfer member 112 defines cutouts at parts of the bottom and/or side walls thereof that are sized/shaped so as to substantially match/conform to the profile of the deck material. By including such cutouts in transfer member 112, which may be formed through a punching operation or other fabrication technique, as will be apparent to persons skilled in the art, it is possible to achieve a substantially perfect fit between deck material 104 and the cutouts formed in transfer member 112.

Figure 20:
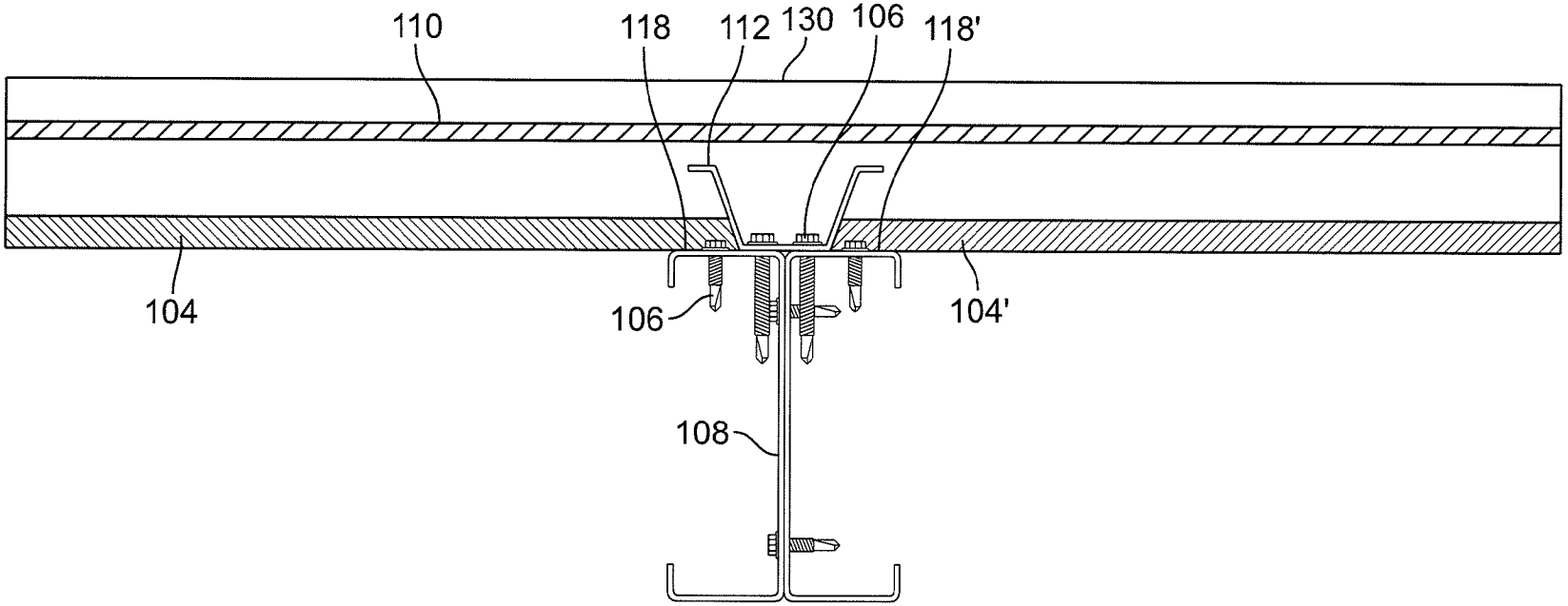
FIG. 20 depicts a cross-sectional side view of an embodiment of a composite floor system.
Figure 21:
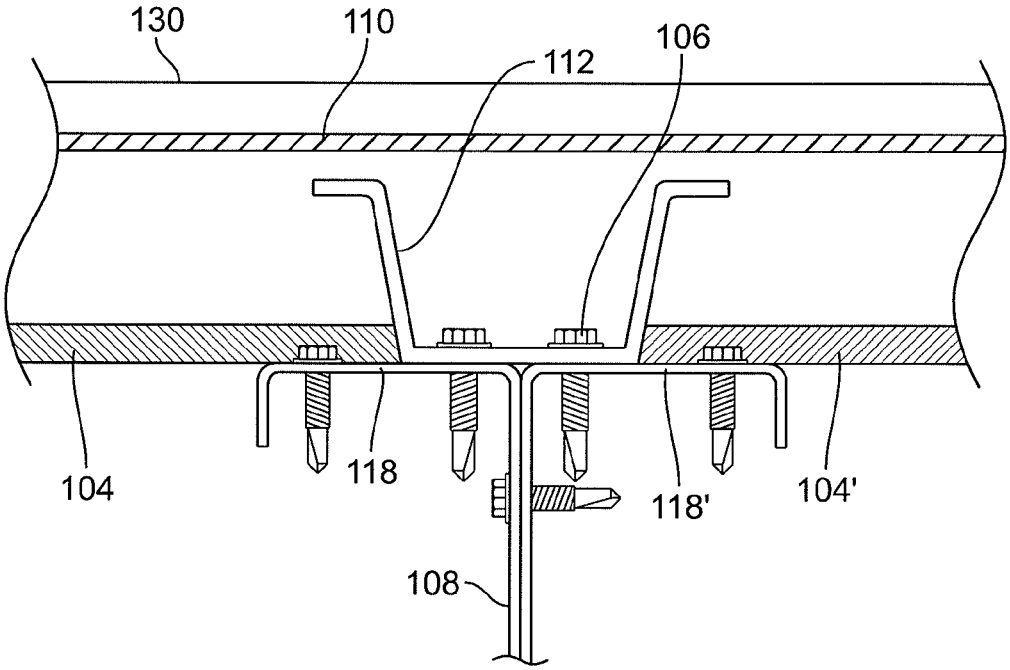
FIG. 21 depicts a cross-sectional side view of an embodiment of a composite floor system.
Figure 22:
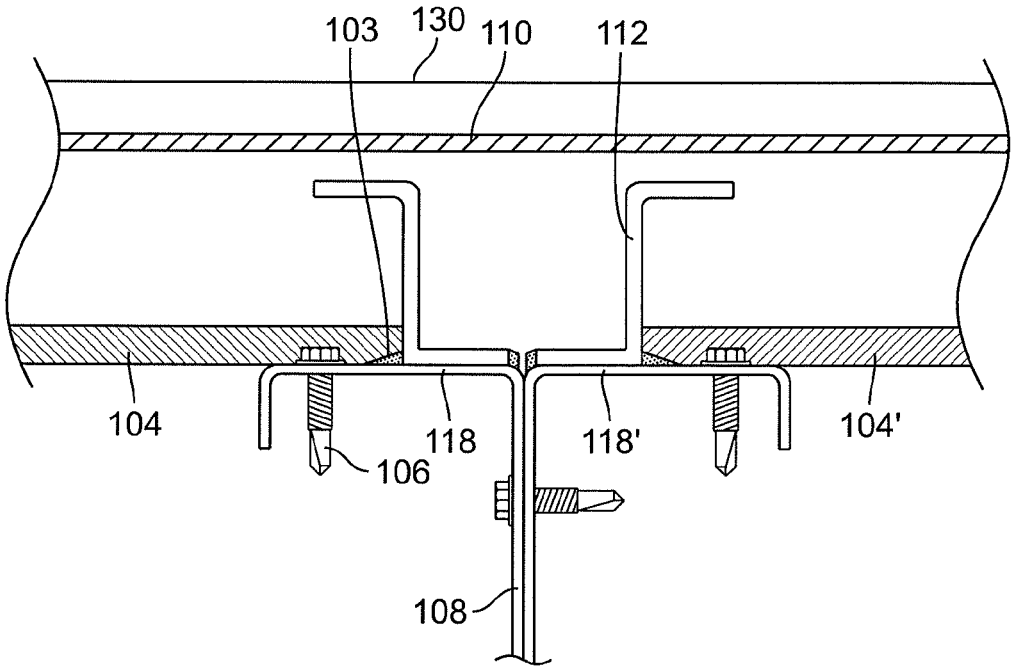
FIG. 22 depicts a cross-sectional side view of an embodiment of a composite floor system.

As shown in FIG. 20, the transfer member 112 is seated directly on the top flanges of the beams 118, 118' of the support member 108 by conventional fastening methods, such as bolting (as shown by the hex washer head self-drilling screws 106 disclosed in FIG. 21) or welding (as shown by the weld regions 103 disclosed in FIG. 22). In this manner, a structural gap is created between the transfer member 112 and the beams 118, 118'. In certain embodiments, the weld regions 103 are produced via a welding process.

Figure 23:
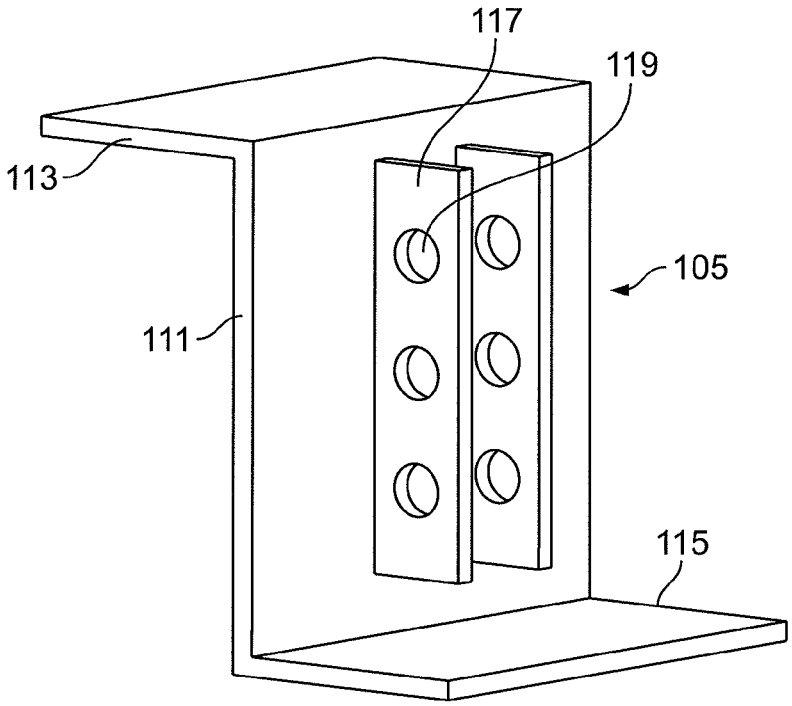
FIG. 23 depicts a perspective view of an embodiment of a hanger.
Figure 25:
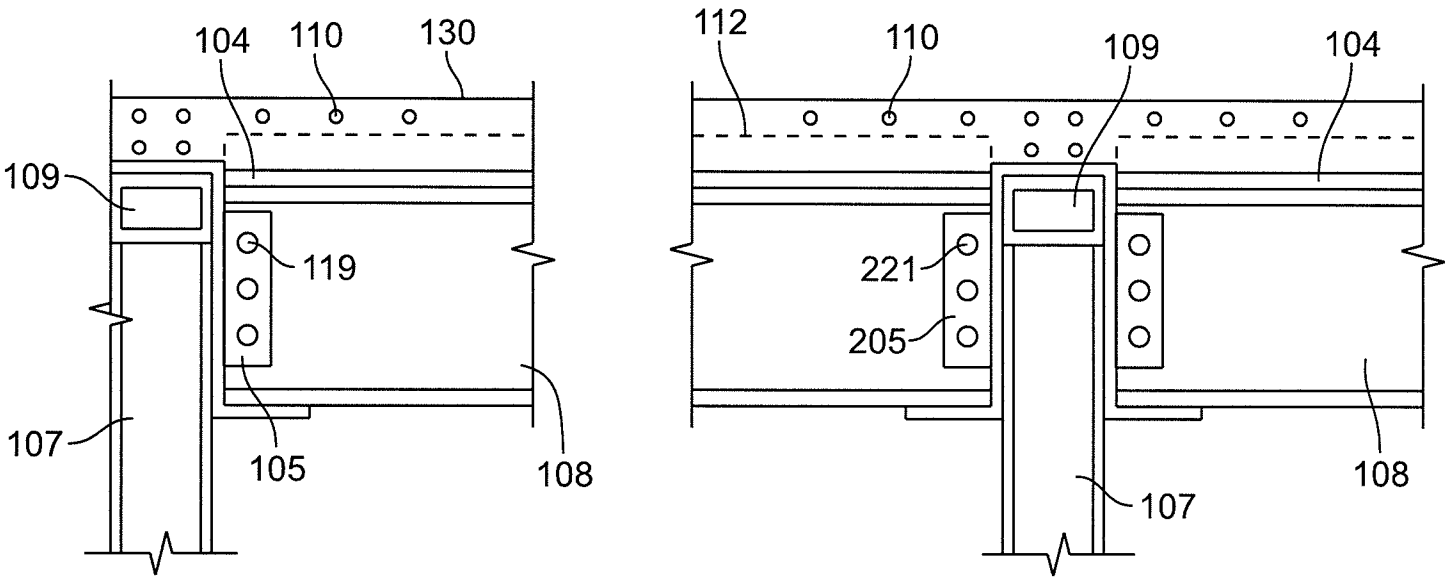
FIG. 25 depicts a cross-sectional view of an embodiment of a composite floor system with associated hangers.

As shown in FIG. 23, a hanger 105 is sized to provide a seating place for the composite floor system. The hanger 105 is sized to support the beams 118, 118' against the wall 107 (see FIG. 25) or a wall panel and the beam 109, such as a steel tube. In particular, the hanger 105 includes a main wall 111, a top wall 113 protruding from the main wall 111 in one direction, a bottom wall 115 protruding from the main wall 111 in an opposite direction. The hanger 105 includes a pair of brackets 117 protruding from the main wall 111. The brackets 117 are sized to contain the beams 118, 118' by conventional fastening methods through apertures 119 formed in the brackets 117. The hanger 105 could be made from any suitable material, such as steel.

Figure 24:
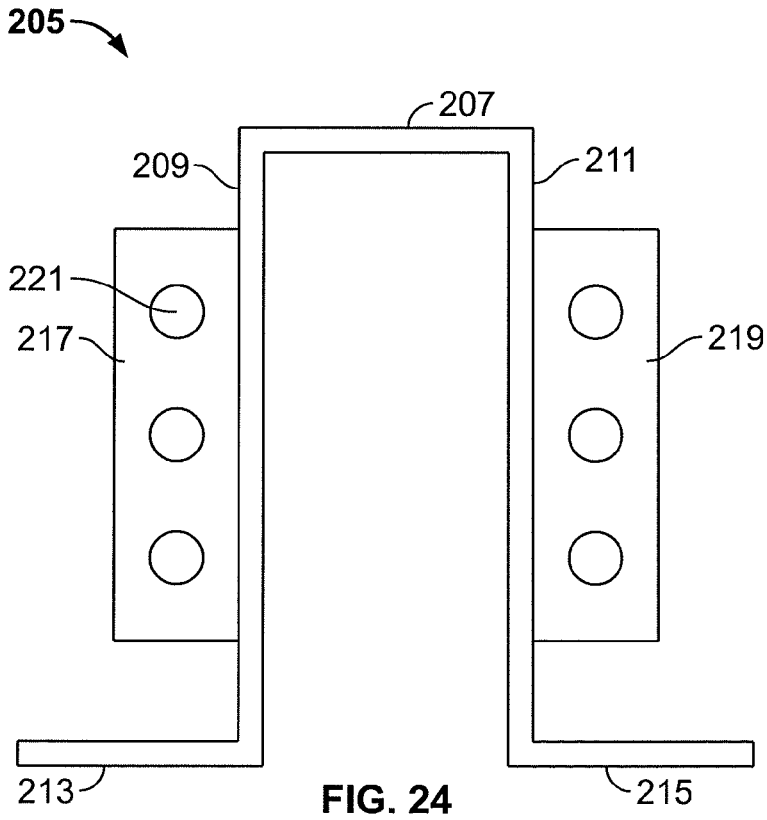
FIG. 24 depicts a perspective view of an alternative embodiment of a hanger.

An alternative embodiment of the hanger 205 is provided in FIG. 24. The hanger 205 includes a top wall 207, a first main wall 209 connected to one end of the top wall 207, a second main wall 211 connected to the opposite end of the top wall 207, a first bottom wall 213 protruding from the first main wall 209, and a second bottom wall 215 protruding from the second main wall 211. A first pair of brackets 217 protrudes from the first main wall 209, and a second pair of brackets 219 protrudes from the second main wall 211. The brackets 217, 219 are sized to contain the beams 118, 118' by conventional fastening methods through apertures 221 formed in the brackets 217, 219.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

What is claimed is:

1. A composite floor system, comprising:

a slab;

a deck material sized and shaped to support said slab;

a support member positioned below said deck material; and a transfer member attached to said support member, said transfer member including an elongated body having a bottom with a first edge and a second edge opposite said first edge, a first side wall extending upwardly from said first edge of said bottom, and a second side wall extending upwardly from said second edge of said bottom, said transfer member sized and configured to increase transfer of shear forces between said slab and said support member;

wherein said transfer member defines bottom and side walls, and wherein cutouts are defined in the bottom and side walls to closely cooperate with said deck material; and wherein the transfer member is embedded in the slab such that the slab substantially surrounds the transfer member.

2. The composite floor system of claim 1, wherein said transfer member is attached directly to said support member.

3. The composite floor system of claim 2, wherein said transfer member is cold-formed and said support member is cold-formed.

4. The composite floor system of claim 3, wherein said deck member is positioned permanently above said support member and is non-removable.

5. The composite floor system of claim 4, wherein said deck material has a length, and said support member has a length, said length of said deck member is substantially the same as said length of said support member.

6. The composite floor system of claim 1, wherein said transfer member is a furring channel made of steel.

7. The composite floor system of claim 1, further comprising a reinforcing bar positioned on top of said transfer member, said reinforcing bar being perpendicular relative to said transfer member, said reinforcing bar sized and shaped to prevent transverse cracking in said slab.

8. The composite floor system of claim 1, wherein said support member includes a first metal joist having a first side wall and a second metal joist having a second side wall, said first side wall positioned proximate to said second side wall.

9. The composite floor system of claim 8, wherein said first joist and said second joist are substantially C-shaped.

10. The composite floor system of claim 9, wherein said transfer member is attached directly to said first joist and to said second joist through welding.

11. The composite floor system of claim 1, further comprising a hanger sized to support said support member.

12. The composite floor system of claim 11, wherein said hanger includes a main wall, a top wall protruding from said main wall in one direction, and a bottom wall protruding from said main wall in an opposite direction.

13. The composite floor system of claim 12, wherein said hanger includes a pair of brackets protruding from said main wall, said pair of brackets including apertures.

14. The composite floor system of claim 11, wherein said hanger includes a top wall, a first main wall connected to said top wall, a second main wall connected to said top wall, a first bracket protruding from said first main wall, and a second bracket protruding from said second main wall.

15. A composite floor system comprising:

a slab;

a deck material sized and shaped to support said slab;

a support member attached to said deck material, said support member including a first beam with a first side wall having a first top edge and a first bottom edge, said first beam including a first flange extending from said first top edge of said first side wall, and a second beam with a second side wall having a second top edge and a second bottom edge, said second beam including a second flange extending from said second top edge of said second side wall, said first side wall positioned proximate said second side wall; and a transfer member attached to said deck material and said support member and sized and configured to increase transfer of shear forces between said slab and said support member;

wherein said transfer member defines bottom and side walls, and wherein cutouts are defined in the bottom and side walls to closely cooperate with said deck material; and wherein the transfer member is embedded in the slab such that the slab substantially surrounds the transfer member.

16. The composite floor system of claim 15, wherein said first beam is substantially C-shaped, and said second beam is substantially C-shaped.

17. The composite floor system of claim 16, wherein said first beam and second beam include openings formed in said first and second side walls.

18. The composite floor system of claim 17, wherein said transfer member includes a elongated, trough-like body.

* * * * *